United States Patent [19]

Shindo et al.

[11] Patent Number: 4,962,890

[45] Date of Patent: Oct. 16, 1990

[54] FUEL INJECTION VALVE ASSEMBLY

[75] Inventors: Takashi Shindo; Shiro Kurosawa; Kazuhiko Sato, all of Matsuyma, Japan

[73] Assignee: Diesel Kiki Co., Ltd., Japan

[21] Appl. No.: 411,560

[22] Filed: Sep. 22, 1989

[30] Foreign Application Priority Data

Sep. 19, 1988 [JP] Japan ..... 63-121648[U]
Mar. 6, 1989 [JP] Japan ..... 1-51949

[51] Int. Cl.[5] ..... F02M 61/10
[52] U.S. Cl. ..... 239/533.4; 239/533.9
[58] Field of Search ..... 239/533.2, 533.3, 533.4, 239/533.5, 533.9

[56] References Cited

U.S. PATENT DOCUMENTS

| | | | |
|---|---|---|---|
| 4,359,191 | 11/1982 | Uchida | 239/533.5 |
| 4,390,129 | 6/1983 | Uchida | 239/533.5 |
| 4,448,356 | 5/1984 | Nakajima et al. | 239/533.5 |
| 4,768,719 | 9/1988 | Straubel et al. | 239/533.4 |

*Primary Examiner*—Andres Kashnikow
*Assistant Examiner*—Karen B. Merritt
*Attorney, Agent, or Firm*—Ostrolenk, Faber, Gerb & Soffen

[57] ABSTRACT

A two-stage opening fuel injection valve assembly, including a valve element having an initial position providing a zero flow rate of fuel through the valve assembly, a first critical position displaced a predetermined distance from the initial position and providing a first flow rate of fuel through the valve assembly, a second critical position further displaced a predetermined distance from the first critical position and providing a second flow rate of fuel through the valve assembly, first and second movable members engageable with the valve element independently of each other, a flange member constantly engaged by the valve element and engageable with each of the first and second movable members, a first spring urging the first movable member to engage the flange member when the valve element is held in the initial position, the first spring being operative to maintain the engagement between the first movable member and the flange member when the valve element is located between the initial position and the first critical position, and a second spring urging the second movable member to engage the flange member when the valve element is moved from the initial position to one of the first and second critical positions, the second spring being operative to maintain the engagement between the second movable member and the flange member when the valve element is located between the first and second critical positions.

21 Claims, 9 Drawing Sheets

FUEL INJECTION VALVE ASSEMBLY

FIELD OF THE INVENTION

The present invention relates to a fuel injection valve for use in a diesel engine and, particularly, to a fuel injection valve of a two-stage opening type which has two successive steps of fuel injection for each cycle of operation of a power cylinder of a diesel engine.

BACKGROUND OF THE INVENTION

A diesel engine using a fuel injection valve of the two-stage valve opening type is used to suppress the instability of operation typically represented by the diesel knock caused during injection of fuel. A diesel engine of this nature is also useful for precluding the delay in firing timings and controlling the emission of nitrogen oxides.

A fuel injection valve of the two-stage valve opening type has two successive fuel discharge steps for each cycle of fuel injection. Fuel is injected into the associated one of the power cylinders of the engine in quantities respectively predetermined for the two fuel discharge steps. The quantities of the fuel to be discharged from the fuel injection valve assembly during the two fuel discharge steps are dictated by the amounts of movement of a needle valve element 42 incorporated in the fuel injection valve assembly. Specifically, the quantity of fuel to be discharged from the fuel injection valve assembly during the first or earlier fuel discharge step is determined by the preliminary valve lift PL of the fuel injection valve assembly, that is, the period of time for which the needle valve element 42 is moved from its initial axial position to a predetermined first critical axial position of the valve element. Likewise, the quantity of fuel to be discharged from the fuel injection valve assembly during the second or later fuel discharge step is determined by the full valve lift FL of the fuel injection valve assembly, that is, the period of time for which the needle valve element 42 is moved from the first critical axial position to a predetermined second critical axial position of the valve element. A fuel injection valves of this type is disclosed in, for example, Japanese Provisional Utility Model Publication (Kokai) No. 56-129568.

The two-stage opening fuel injection valve assembly disclosed in the Provisional Utility Model Publications No. 56-129568 uses two pressure springs which control the movements, respectively, of the needle valve element 42 for the two fuel discharge steps of each cycle of fuel injection. These two pressure springs are arranged in series and are seated on movable spring seat elements which are respectively associated with the pressure springs. One of the pressure springs contributes to the primary valve lift for the earlier fuel discharge step and the other to the main valve lift for the later fuel discharge step.

The prior-art fuel injection valve assembly has a drawback which results from the fact that the movable spring seat element contributing to the preliminary valve lift of the fuel injection valve assembly is intricate in shape. Extremely high techniques are thus required for controlling the dimensional accuracies of the spring seat element and the associated members and elements during machining, assembling and adjusting of these members and elements to provide a preliminary valve lift PL with a satisfactorily high degree of preciseness. It may be noted that generally more exacting control is required over the preliminary valve than over the main valve lift in a fuel injection valve assembly of the two-stage opening type.

Attempts have therefore been made to provide useful solutions to this problem of the prior-art fuel injection valve of the described construction. Typical of such attempts include those which have resulted in fuel injection valves disclosed in the Japanese Provisional Utility Model Publications (Kokai) No. 56-173757 and No. 61-184866. The prior-art fuel injection valve shown in each of these publications is characterized in that the pressure springs providing the preliminary and main valve lifts, respectively, are arranged in parallel. The parallel arrangement of the two pressure springs is useful for reducing the number of members and elements which affect the degree of accuracy of, particularly, the preliminary valve lift and alleviating the requirement for high techniques in machining, assembling and adjusting the component members and elements of the fuel injection valve assembly.

The improvement achieved by the prior-art two-stage opening fuel injection valve assembly taught in these publications are however not fully satisfactory.

SUMMARY OF THE INVENTION

It is, accordingly, an important object of the present invention to provide an improved two-stage opening fuel injection valve assembly which will dispense with the high techniques that have been required for the machining, assembling and adjusting of members and elements contributing the preliminary valve lift.

It is another important object of the present invention to provide an improved two-stage opening fuel injection valve assembly in which the preliminary valve lift can be precisely defined without having recourse to high precision machining and can be accurately adjusted with utmost ease.

It is still another important object of the present invention to provide an improved two-stage opening fuel injection valve assembly in which the preliminary valve lift is defined by members each of which is sufficiently simple in shape and which can therefore be machined, assembled and adjusted with ease and manufactured at low cost.

Yet, it is still another important object of the present invention to provide an improved two-stage opening fuel injection valve assembly which can utilize the needle valve element of an existing fuel injection valve assembly of the two-stage opening type.

In accordance with a first outstanding of the present invention, there is provided a two-stage opening fuel injection valve assembly, comprising (a) a valve element having an initial position providing a substantially zero flow rate of fuel through the valve assembly, a first critical position displaced a first predetermined distance from the initial position in a predetermined direction and providing a first flow rate of fuel through the valve assembly, a second critical position further displaced a second predetermined distance from the first critical position in the predetermined direction and providing a second flow rate of fuel through the valve assembly, (b) first and second movable members which are engageable with the valve element independently of each other, (c) intermediate means constantly engaged by the valve element and engageable with each of the first and second movable members, (d) first biasing means urging the first movable member toward a predetermined position to engage the intermediate means when the valve element is held in the initial position, the first biasing means being operative to maintain the engagement between the first movable member and the intermediate means when the valve element is located between the initial position and the first critical position, (e) second biasing means urging the second movable member toward a predetermined position to engage the intermediate means when the valve element is moved from the initial position to one of the first and second critical positions, the second biasing means being operative to maintain the engagement between the second movable member and the intermediate means when the valve element is located between the first and second critical positions, and (f) displacement limiting means preventing movement of the valve element beyond the second critical position in the predetermined direction.

In accordance with a second outstanding of the present invention, there is provided a two-stage opening fuel injection valve assembly having a full valve lift and a preliminary valve lift which forms part of the full valve lift, comprising (a) a casing structure having formed therein a fuel passageway into which is to be directed fuel under pressure, a substantially flat fixed internal surface portion, and first and second chambers arranged in series with each other perpendicularly to the fixed internal surface portion, (b) first and second biasing means provided in the first and second chambers, respectively, (c) a first movable member movable in part within the first chambers and in part within the second chambers, (d) a second movable member movable within the second chambers and located in the vicinity of the end of the second chambers opposite to the first chamber, the second movable member having an end face substantially parallel with and confronting the fixed internal surface portion, the second biasing means constantly engaging the second movable member for urging the second movable member into contact with the fixed internal surface portion, (e) a valve element located in the vicinity of the second movable member and movable toward and away from the second movable member for controlling the flow rate of fuel through the fuel passageway, (f) the first movable member being constantly engaged by the first biasing means and the valve element in the presence of fuel pressure in the fuel passageway for transmitting from the first biasing means to the valve element a force urging the valve element toward a predetermined initial position with respect to the second movable member held in contact with the fixed internal surface portion, and (g) intermediate means intervening between the first movable member and the valve element, the intermediate means being movable with the valve element and having an end face substantially parallel with and located adjacent to the end face of the second movable member, (h) the distance between the end face of the second movable member and the end face of the intermediate means engaging the valve element held in the initial position defining the amount of the preliminary valve lift.

BRIEF DESCRIPTION OF THE ACCOMPANYING DRAWINGS

The drawbacks of a prior-art two-stage opening fuel injection valve assembly of the nature to which the present invention appertains and the features and advantages of a two-stage opening fuel injection valve assembly according to the present invention over such a prior-art two-stage opening fuel injection valve assembly will be more clearly understood from the following description taken in conjunction with the accompanying drawings in which like reference numerals and characters designate essentially similar or corresponding units, members, elements and portions and in which.

DETAILED DESCRIPTION OF THE PRIOR ART

Description will be hereinafter made with reference to FIGS. 1 and 2 to more clearly show the drawbacks of a prior-art two-stage opening fuel injection valve assembly of the type to which the present invention generally appertains.

Figure 1:
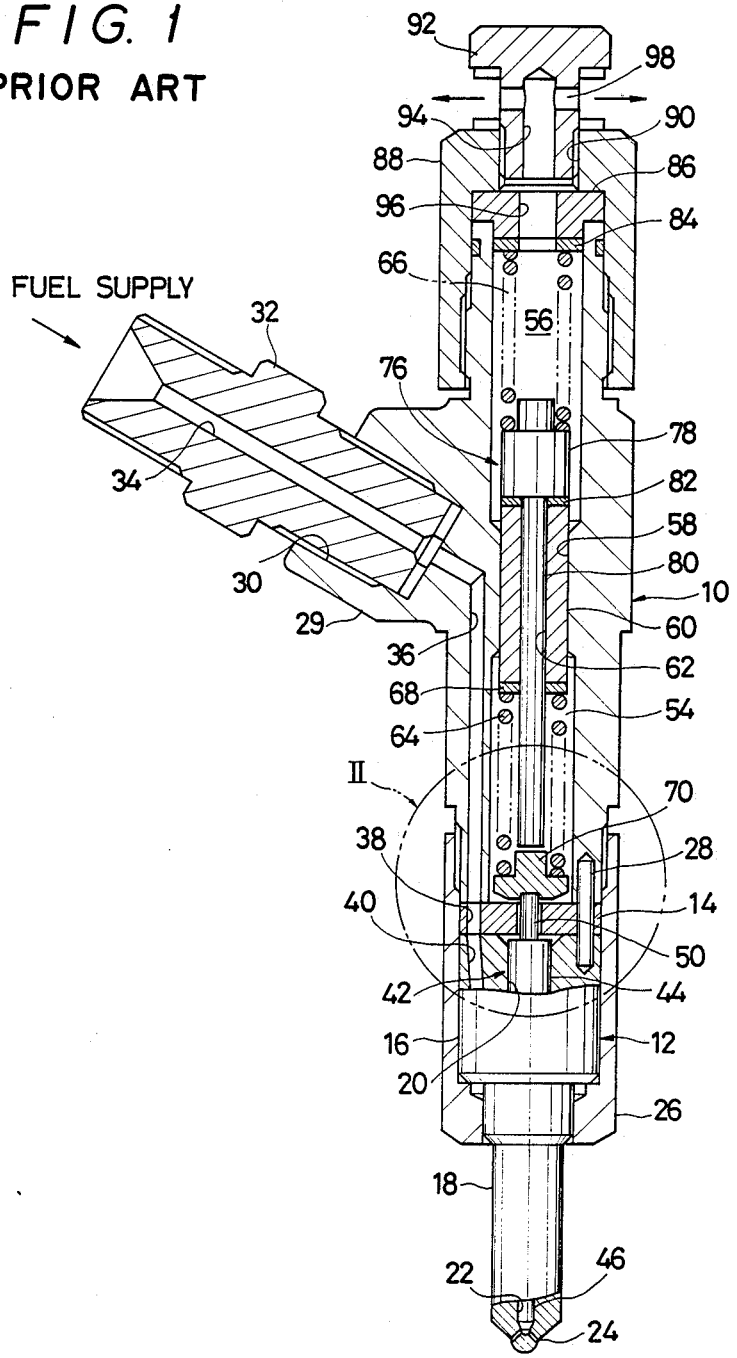
FIG. 1 PRIOR ART
FIG. 1 is a longitudinal sectional view showing an example of a conventional fuel injection valve assembly of the type to which the present invention generally appertains.

Referring first to FIG. 1, a conventional two-stage opening fuel injection valve assembly is largely made up of a nozzle holder 10 and a nozzle member 12 projecting from the nozzle holder 10 through an annular spacer element 14. The nozzle member 12 has a sleeve portion 16 and a tip portion 18 projecting from the sleeve portion 16 and is formed with an axial valve chamber 20 in the sleeve portion 16 and a fuel discharge passageway 22 in the tip portion 18 of the nozzle member 12. The fuel discharge passageway 22 in the tip portion 18 communicates with the axial valve chamber 20 in the sleeve portion 16 and terminates in nozzle orifices 24 located at the leading end of the tip portion 18. The nozzle member 12 is fastened to the nozzle holder 10 by means of a retaining nut member 26 with locating pins 28 secured into the nozzle holder 10 and nozzle member 12 through the spacer element 14 as shown.

The nozzle holder 10 has a lug portion 29 protruding sidewise from the nozzle holder 10 and has formed therein an axial bore 30 having threadedly received therein an axial end portion of a connector 32 formed with an axial fuel passageway 34. A fuel feed pipe leading from a fuel injection pump terminates in this connector 32, though not shown in the drawings.

The nozzle holder 10 is formed with a fuel passageway 36 leading from the fuel passageway 34 in the connector 32 to an aperture 38 formed in the spacer element 14 so that the fuel directed into the fuel passageway 36 in the nozzle holder 10 is passed through the aperture 38 in the spacer element 14 into a fuel passageway 40 formed in the sleeve portion 16 of the nozzle member 12. The fuel passageway 40 in the sleeve portion 16 of the nozzle member 12 terminates in the fuel discharge passageway 22 in the nozzle member 12 so that the fuel passed to the fuel passageway 40 in the nozzle member 12 is discharged through the nozzle orifices 24 in the nozzle member 12.

The nozzle member 12 has received therein a needle valve element 42 having a guide portion 44 and a rod portion 46 axially projecting from the guide portion 44. The guide portion 44 is axially slidable in the valve chamber 20 in the nozzle member 12 and the rod portion 46 extends through the fuel discharge passageway 22 in the nozzle member 12 and is needle-pointed toward the leading end of the fuel discharge passageway 22. The fuel discharge passageway 22 in the nozzle member 12 is thus closed or opened at its leading end by the pointed end of the rod portion 46 of the valve element 42 as the valve element 42 is axially moved in the nozzle member 12. The needle valve element 42 further has a stem portion 50 projecting from the opposite end of the guide portion 44 of the valve element 42. The stem portion 50 of the needle valve element 42 extends through a central opening 52 formed in the spacer element 14 as illustrated to an enlarged scale in FIG. 2 and projects into the nozzle holder 10.

The nozzle holder 10 is formed with an axial bore extending from one end of the nozzle holder 10 to the other and having a bore portion forming a first spring chamber 54 terminating at the end of the nozzle holder 10 close to the spacer element 14, and a bore portion forming a second spring chamber 56 terminating at the opposite end of the nozzle holder 10. The axial bore in the nozzle holder 10 further has an intermediate bore portion 58 axially intervening between the first and second spring chambers 54 and 56 as shown. In the intermediate bore portion 58 of the nozzle holder 10 is closely received a sleeve member 60 formed with an axial bore 62 extending throughout the length of the sleeve member 60. The sleeve member 60 projects at one end into the first spring chamber 54 and at the other into the second spring chamber 56.

In the first and second spring chambers 54 and 56 of the nozzle holder 10 are incorporated first and second pressure springs 64 and 66, respectively. The first pressure spring 64 axially extends in the first spring chamber 54 of the nozzle holder 10 and is seated at one end on an adjustment shim 68 received on one end face of the sleeve member 60. The pressure spring 64 is seated at the other end on a movable spring seat element 70 located close to the spacer element 14 as shown.

Figure 2:
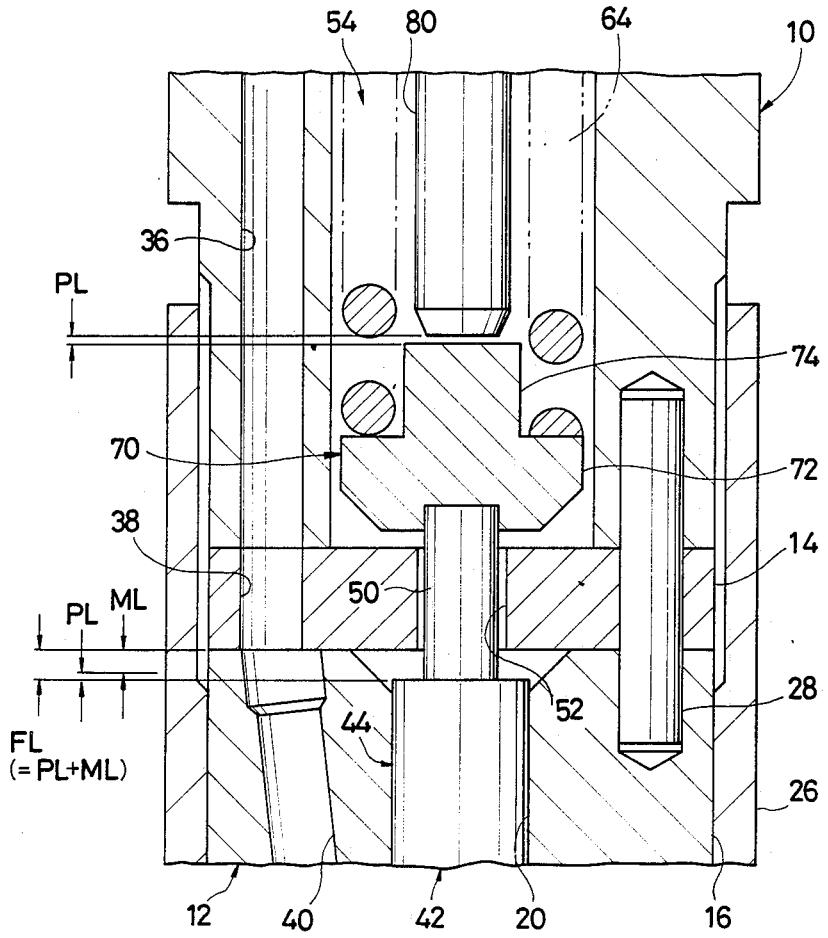
FIG. 2 PRIOR ART
FIG. 2 is a sectional view showing, to an enlarged scale, the detailed construction of a portion of the valve assembly of FIG. 1 indicated at II in FIG. 1.

As will be better seen in FIG. 2, the movable spring seat element 70 has a flange portion 72 located close to the spacer element 14 and an axial lug portion 74 axially projecting from the flange portion 72 in a direction opposite to the spacer element 14. The stem portion 50 of the needle valve element 42 axially projects through the opening 52 in the spacer element 14 into the first spring chamber 54 of the nozzle holder 10 and engages at its leading end with the flange portion 72 of the spring seat element 70.

The first pressure spring 64 thus seated on the movable spring seat element 70 urges the spring seat element 70 toward the inner end face of the spacer element 14. In the presence of fuel under pressure in the in the fuel discharge passageway 22 in the nozzle member 12, the needle valve element 42 is forced by the fuel pressure to axially move toward the movable spring seat element 70 and has its stem portion 50 engaged at its leading end by the flange portion 72 of the spring seat element 70. The force of the first pressure spring 64 urging the spring seat element 70 toward the spacer element 14 is transmitted through the spring seat element 70 to the needle valve element 42 and urges the needle valve element 42 to stay in an "initial" axial position closing the fuel discharge passageway 22 in the nozzle member 12, opposing the force of the fuel under pressure forcing the needle valve element 42 to axially move in a direction to open the fuel discharge passageway 22 in the needle valve element 42.

Within the nozzle holder 10 is further incorporated a push rod 76 having a boss portion 78 and a rod portion 80 projecting from the boss portion 78. The boss portion 78 of the push rod 76 is axially movable in the second spring chamber 56 and has one end face engageable with an adjustment shim 82 received on the other end face of the sleeve member 60. The second pressure spring 66 provided in the second spring chamber 56 is seated at one end on the other end face of the boss portion 78 of the push rod 76 and at the other end on an adjustment shim 84 received on a fixed spring seat element 86. The fixed spring seat element 86 is secured by a cap member 88 to the nozzle holder 10 at its end opposite to the spacer element 14 as shown. The cap member 88 has an opening 90 through which a plug member 92 is fitted to the cap member 88. The plug member 92 has an axial bore 94 communicating with the second spring chamber 56 in the nozzle holder 10 through an axial bore 96 in the spring seat element 86 and drain ports 98 sidewise leading from the axial bore 94. The axial bore 94 and drain ports 98 thus formed in the plug member 92 allow leakage fuel out of the fuel injection valve assembly therethrough.

The rod portion 80 of the push rod 76 projects from the boss portion 78 of the push rod 76 and extends through the axial bore 62 in the sleeve member 60 into the first spring chamber 54. The rod portion 80 extends toward the lug portion 74 of the movable spring seat element 70 and has an end face engageable with the end face of the lug portion 74 of the spring seat element 70. The second pressure spring 66 seated on the boss portion 78 of the push rod 76 urges the push rod 76 toward the lug portion 74 of the movable spring seat element 70 until the boss portion 78 of the push rod 76 is received on the sleeve member 60 through the adjustment shim 82.

When the movable spring seat element 70 is engaged by the stem portion 50 of the needle valve element 42 in the presence of fuel under pressure in the fuel discharge passageway 22 in the nozzle member 12, the spring seat element 70 will be caused to move into engagement at the end of its axial lug portion 74 with the end face of the rod portion 80 of the push rod 76. The force of the second pressure spring 66 urging the push rod 76 toward the spring seat element 70 is transmitted through the push rod 76 to the spring seat element 70 and further through the spring seat element 70 to the needle valve element 42, thus further opposing the force of the fuel under pressure forcing the needle valve element 42 to axially move in the direction to open the fuel discharge passageway 22 in the needle valve element 42. The needle valve element 42 moved in the direction to open the fuel discharge passageway 22 in the nozzle member 12 by the force of fuel under pressure is thus subjected first to the opposing force of the first pressure spring 64 and thereafter to the opposing forces of both of the first and second pressure springs 64 and 66.

During each cycle of operation of the diesel engine, the fuel under pressure supplied from the fuel injection pump is admitted through the fuel feed pipe into the fuel passageway 34 in the connector 32 and is directed through the fuel passageway 36 in the nozzle holder 10, the aperture 38 in the spacer element 14 and the fuel passageway 40 in the nozzle member 12 into the fuel discharge passageway 22 in the nozzle member 12. The fuel pressure thus developed in the fuel discharge passageway 22 in the nozzle member 12 acts on the needle valve element 42 and forces the needle valve element 42 to axially move toward the movable spring seat element 70, that is, in the direction to open the fuel discharge passageway 22 in the needle valve element 42 until the needle valve element 42 has its stem portion 50 engaged at its end by the flange portion 72 of the spring seat element 70. The force of the first pressure spring 64 urging the movable spring seat element 70 toward the spacer element 14 is transmitted through the spring seat element 70 to the needle valve element 42 and opposes the force of the fuel under pressure acting on the needle valve element 42. The needle valve element 42 is accordingly caused to move with the spring seat element 70 against the force of the first pressure spring 64 until the lug portion 74 of the spring seat element 70 has its end face brought into pressing engagement with the end face of the rod portion 80 of the push rod 76. The distance of movement of the needle valve element 42 which is thus moved from its initial axial position to a first "critical" axial position having the movable spring seat element 70 brought into pressing engagement with the rod portion 80 of the push rod 76 provides the preliminary valve lift of the fuel injection valve assembly under consideration as indicated by PL in FIG. 2.

The needle valve element 42 being moved the distance providing the preliminary valve lift PL, the fuel discharge passageway 22 in the nozzle member 12 is allowed to open so that the fuel which has been passed to the fuel discharge passageway 22 is discharged through the nozzle orifices 24 in the nozzle member 12 at a rate dictated by the preliminary valve lift PL of the fuel injection valve assembly.

By the fuel pressure developed in the fuel discharge passageway 22 in the nozzle member 12, the needle valve element 42 is caused to further move, now together with the push rod 76, in the direction to wider open the fuel discharge passageway 22 in the nozzle member 12. The force of the fuel under pressure urging the needle valve element 42 to move in this direction is now opposed by not only the force of the first pressure spring 64 but also the force of the second pressure spring 66. The needle valve element 42 is thus caused to further move against the forces of the first and second pressure springs 64 and 66 until the guide portion 44 of the needle valve element 42 has its inner end face brought into contact with the outer end face of the spacer element 14. The distance of movement of the needle valve element 42 which is thus moved from its first critical axial position to a second "critical" axial position having the guide portion 44 thus brought into contact with the spacer element 14 provides the full valve lift FL of the fuel injection valve assembly under consideration as indicated by ML in FIG. 2.

The needle valve element 42 being further moved the distance providing by the full valve lift FL, the fuel discharge passageway 22 in the nozzle member 12 is allowed to wider open so that the fuel in the fuel discharge passageway 22 in the nozzle member 12 is further discharged through the nozzle orifices 24 in the nozzle member 12 at an increased rate dictated by the full valve lift FL of the fuel injection valve assembly. The full valve lift FL of the fuel injection valve assembly is defined as the sum of the preliminary valve lift PL and the full valve lift FL of the valve assembly as shown in FIG. 2.

As has been described, the prior-art fuel injection valve assembly of the two-stage opening type has two successive fuel discharge steps for each cycle of operation of the associated power cylinder of the diesel engine. The quantity of fuel discharged from the nozzle member 12 into the power cylinder during the first or earlier fuel discharge step is dictated by the preliminary valve lift PL of the fuel injection valve assembly, that is, the period of time for which the needle valve element 42 is moved from the initial axial position to the first critical axial position of the valve element 42. Likewise, the quantity of fuel discharged from the nozzle member 12 into the power cylinder during the second or later fuel discharge step is dictated by the full valve lift FL of the fuel injection valve assembly, that is, the period of time for which the needle valve element 42 is moved from the first critical axial position to the second critical axial position of the valve element 42.

The various measurements of the fuel injection valve assembly that are predominant over these periods of time, that is, the preliminary and main valve lifts PL and ML of the valve assembly are selected so that the preliminary valve lift PL is smaller than the full valve lift FL. The preliminary valve lift PL is determined by the initial spacing between the end face of the lug portion 74 of the movable spring seat element 70 and the end face of the rod portion 80 of the push rod 76 and depends for its preciseness on the flatness and smoothness of each of these end faces of the spring seat element 70 and push rod 76, and the degree of parallelism between the end faces of the spring seat element 70 and push rod 76. The movable spring seat element 70 used in the shown prior-art fuel injection valve assembly being intricate in shape, extremely high techniques are required for controlling the dimensional accuracies of the spring seat element 70 and the associated members and elements during machining, assembling and adjusting of these members and elements to provide a preliminary valve lift PL with a satisfactorily high degree of preciseness.

Various attempts have therefore been made to provide useful solutions to this problem of the prior-art fuel injection valve of the described construction. Examples of the prior-art fuel injection valves which have resulted from these attempts are disclosed in the previously named Japanese Provisional Utility Model Publications (Kokai) No. 56-173757 and No. 61-184866. The prior-art fuel injection valve shown in each of these publications is characterized, inter alia, by the parallel arrangement of the first and second pressure springs providing the preliminary and main valve lifts, respectively, of the valve assembly. The parallel arrangement of the two pressure springs is useful for reducing the number of members and elements which affect the degree of accuracy of, particularly, the preliminary valve lift and accordingly for alleviating the requirement for the extremely high techniques in machining various members and elements of the fuel injection valve assembly.

The improvement achieved by the prior-art two-stage opening fuel injection valve assembly taught in the Provisional Utility Model Publication No. 56-173757 uses a movable spring seat element constantly engaged by the needle valve element 42 and associated with one of the pressure springs arranged in parallel. The movable spring seat element used in this prior-art fuel injection valve assembly is identical in shape to its counterpart in the fuel injection valve assembly hereinbefore described with reference to FIGS. 1 and 2 and, for this reason, the fuel injection valve assembly proposed by this publication also has the problem hereinbefore pointed out of the prior-art fuel injection valve assembly shown in FIGS. 1 and 2 and is not fully acceptable. The fuel injection valve assembly disclosed in this publication further a drawback in that the needle valve element 42 included therein could not be utilized without modification in a fuel injection valve assembly of the type to which the present invention generally appertains such as the prior-art valve assembly of FIGS. 1 and 2.

On the other hand, the two-stage opening fuel injection valve assembly disclosed in the Japanese Provisional Utility Model Publication No. 61-184866 uses a fixed spring seat element common to both of the pressure springs arranged in parallel. The dimensional accuracy of the fixed spring seat element thus provided commonly to the two pressure springs contributes to the degrees of preciseness of both of the preliminary and main valve lifts. A dimensional error, if any, of the common fixed spring seat element would thus result in an error in each of the preliminary and main valve lifts and would thus amplify the error in the total valve lift which is given as the sum of the preliminary and main valve lifts.

PREFERRED EMBODIMENTS OF THE INVENTION

Figure 3:
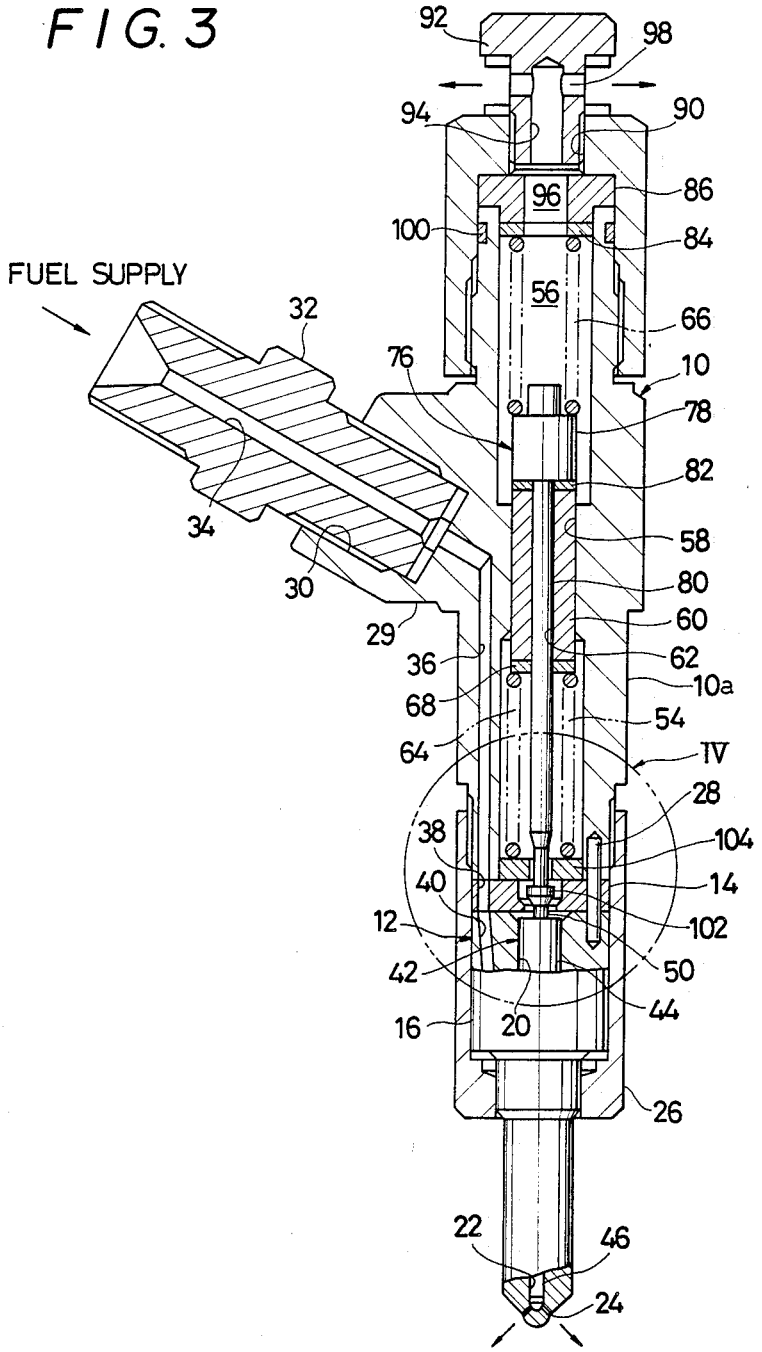
FIG. 3 is a longitudinal sectional view showing a first preferred embodiment of a fuel injection valve assembly according to the present invention.
Figure 4:
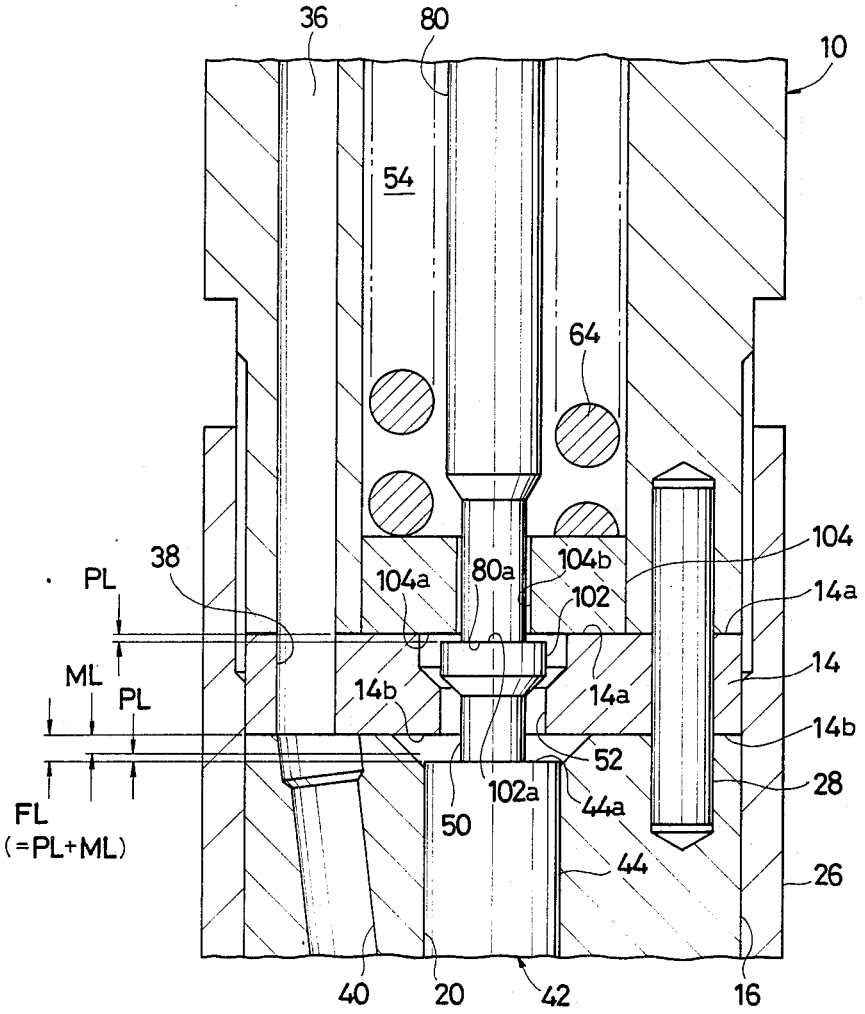
FIG. 4 is a sectional view showing, to an enlarged scale, the detailed construction of a portion of the valve assembly of FIG. 3 indicated at IV in FIG. 3.

[First Preferred Embodiment] (FIGS. 3 and 4)

FIGS. 3 and 4 show a first preferred embodiment of a two-stage opening fuel injection valve assembly to overcome these and other drawbacks of a prior-art two-stage opening fuel injection valve assembly.

The two-stage opening fuel injection valve assembly embodying the present invention as herein shown is in various respects similar in construction to the prior-art fuel injection valve assembly hereinbefore described with reference to FIGS. 1 and 2. Thus, the two-stage opening fuel injection valve assembly embodying the present invention comprises a valve casing structure composed of an elongated, generally cylindrical nozzle holder 10 and a nozzle member 12 projecting from the nozzle holder 10 through an annular spacer element 14. The annular spacer element 14 thus axially intervening between the nozzle holder 10 and nozzle member 12 has opposite, parallel flat end faces which consist of a first or inner end face 14*a* contiguous to the nozzle holder 10 and a second or outer end face 14*b* contiguous to the nozzle member 12 as illustrated to an enlarged scale in FIG. 4. These inner and outer end faces 14*a* and 14*b* of the spacer element 14 provide first and second fixed internal surface portions, respectively, of a two-stage opening valve assembly according to the present invention.

The nozzle member 12 has a generally cylindrical sleeve portion 16 and a tip portion 18 axially projecting from the sleeve portion 16 in a direction opposite to the nozzle holder 10. The nozzle member 12 is formed with an axial valve chamber 20 extending in the sleeve portion 16 and a fuel discharge passageway 22 extending longitudinally in the tip portion 18 of the nozzle member 12. The axial valve chamber 20 in the sleeve portion 16 terminates at the end of the nozzle member 12 close to the outer end face 14*b* of the spacer element 14. The fuel discharge passageway 22 in the tip portion 18 of the nozzle member 12 communicates with the axial valve chamber 20 in the sleeve portion 16 and terminates in nozzle orifices 24 located at the leading end of the tip portion 18. The nozzle member 12 is fastened to the nozzle holder 10 by means of an internally threaded retaining nut member 26 fitted to an externally threaded axial portion of the nozzle holder 10. During assembling of the fuel injection valve assembly herein shown, the nozzle holder 10, nozzle member 12 and spacer element 14 are correctly positioned with respect to each other by the aid of parallel locating pins 28 each having opposite end portions fitted into the nozzle holder 10 and nozzle member 12, respectively, through the spacer element 14 as shown.

The nozzle holder 10 has a lateral lug portion 29 protruding sidewise from an intermediate axial portion of the nozzle holder 10 and has formed therein an internally threaded axial bore 30. The axial bore 30 has threadedly received therein an axial end portion of a connector 32 formed with an axial fuel inlet passageway 34 extending between the opposite ends of the connector 32. The connector 32 is herein assumed to form part of the casing structure of the valve assembly under consideration and connects the fuel injection valve assembly to a fuel feed pipe leading from a source of high-pressure fuel typically implemented by a fuel injection pump, though not shown in the drawings. High-pressure fuel is thus supplied from the fuel injection pump and is admitted into the fuel injection valve assembly through the fuel inlet passageway 34 in the connector 32.

The nozzle holder 10 is formed with a fuel passageway 36 leading from the fuel inlet passageway 34 in the connector 32 to the end of the nozzle holder 10 close to the spacer element 14. The fuel passageway 36 in the nozzle holder 10 terminates in an aperture 38 formed in the spacer element 14 so that the fuel directed into the fuel passageway 36 in the nozzle holder 10 by way of the passageway 34 in the connector 32 is passed through the aperture 38 in the spacer element 14 into a fuel passageway 40 formed in the sleeve portion 16 of the nozzle member 12. The fuel passageway 40 thus formed in the sleeve portion 16 of the nozzle member 12 terminates in the fuel discharge passageway 22 in the tip portion 18 of the nozzle member 12. The fuel which has been passed to the fuel passageway 40 in the nozzle member 12 is thus discharged through the nozzle orifices 24 in the tip portion 18 of the nozzle member 12.

The nozzle member 12 has received therein a needle valve element 42 having a cylindrical guide portion 44 and an elongated rod portion 46 axially projecting from one end of the guide portion 44 in a direction opposite to the spacer element 14. The guide portion 44 of the needle valve element 42 is axially slidable in the valve chamber 20 in the sleeve portion 16 of the nozzle member 12 and has a flat end face 44*a* parallel with and confronting the outer end face 14*b* of the spacer element 14 as illustrated in FIG. 4. The rod portion 46 of the needle valve element 42 axially extends through the fuel discharge passageway 22 in the tip portion 18 of the nozzle member 12 and is needle-pointed toward the leading end of the fuel discharge passageway 22 in the tip portion 18. The fuel discharge passageway 22 is thus closed or opened at its leading end by the pointed end of the rod portion 46 of the valve element 42 as the valve element 42 is axially moved in the nozzle member 12.

The needle valve element 42 further has a stem portion 50 axially projecting from the opposite end of the guide portion 44 of the valve element 42. The stem portion 50 of the needle valve element 42 extends into a central opening 52 formed in the spacer element 14 as illustrated to an ellarged scale in FIG. 4.

The nozzle holder 10 is formed with an axial bore extending from one end of the nozzle holder 10 to the other. The axial bore thus formed in the nozzle holder 10 has a bore portion forming a first spring chamber 56 terminating at the end of the nozzle holder 10 remote from the spacer element 14, and a bore portion forming a second spring chamber 54 terminating at the opposite end of the nozzle holder 10 and axially aligned with the first spring chamber 56. It may be noted that the "first" and "second" spring chambers 56 and 54 of the nozzle holder 10 forming part of the embodiment herein shown are referred to conversely to the first and second spring chambers 54 and 56 provided in the nozzle holder 10 of the prior-art fuel injection valve assembly described with reference to FIGS. 1 and 2. The axial bore in the nozzle holder 10 further has an intermediate bore portion 58 axially intervening between these first and second spring chambers 56 and 54 as shown.

In this intermediate bore portion 58 of the nozzle holder 10 is closely received a cylindrical sleeve member 60 formed with an axial bore 62 extending throughout the length of the sleeve member 60. The sleeve member 60 axially projects at one end into the first spring chamber 56 and at the other into the second spring chamber 54. Thus, the sleeve member 60 provides at one end thereof a first fixed seat portion projecting into the first spring chamber 56 and at the other end thereof a second fixed seat portion projecting into the second spring chamber 54 of the nozzle holder 10.

In the first and second spring chambers 56 and 54 of the nozzle holder 10 are incorporated first and second pressure springs 66 and 64, respectively, each in the form of a preloaded helical compression spring. It may be noted that the "first" and "second" pressure springs 66 and 64 of the embodiment herein shown are also referred to conversely to the first and second pressure springs 64 and 66 in the nozzle holder 10 of the prior-art fuel injection valve assembly described with reference to FIGS. 1 and 2.

Within the nozzle holder 10 is further incorporated a push rod 76 having a cylindrical boss portion 78 and an elongated rod portion 80 axially projecting from the boss portion 78. The boss portion 78 of the push rod 76 is axially movable in the first spring chamber 56 and has one end face engageable with an annular adjustment shim 82 received on the first fixed seat portion of the sleeve member 60. The rod portion 80 of the push rod 76 axially extends through the axial bore 62 in the sleeve member 60 into the second spring chamber 54 and has a flat end face directed toward the spacer element 14 located axially opposite to the sleeve member 60.

The first pressure spring 66 provided in the first spring chamber 56 is seated at one end on one end face of the boss portion 78 of the push rod 76 and at the other end on an annular adjustment shim 84 received on a generally annular fixed spring seat element 86 fixedly positioned within the bore portion forming the spring chamber 56. The fixed spring seat element 86 is secured to the nozzle holder 10 at its end opposite to the spacer element 14 by a generally cylindrical cap member 88. The cap member 88 has an end portion formed with an opening 90 through which a plug member 92 is fitted to the cap member 88. The plug member 92 has an axial bore 94 communicating with the first spring chamber 56 in the nozzle holder 10 through an axial bore 96 in the spring seat element 86 and drain ports 98 sidewise leading from the axial bore 94. The axial bore 94 and drain ports 98 thus formed in the plug member 92 and communicating with the first spring chamber 56 in the nozzle holder 10 are provided to allow leakage fuel out of the fuel injection valve assembly therethrough. Between the end portion of the nozzle holder 10 and the cap member 88 is provided a seal element 100 which hermetically seals off the spring chamber 56 to the cap member 88.

The axial stem portion 50 of the needle valve element 42 incorporated in the embodiment herein shown is integral with or terminates in intervening means formed by a flange portion 102 which is larger in diameter than the stem portion 50 and which axially projects into the central opening 52 in the spacer element 14. Thus, the opening 52 in the spacer element 14 has a first axial portion accommodating the stem portion 50 of the needle valve element 42 and open to the axial valve chamber 20 in the sleeve portion 16 of the nozzle member 12 and a second axial portion accommodating the flange portion 102 of the needle valve element 42 and open to the second spring chamber 54 in the nozzle holder 10, as will be clearly seen in FIG. 4. The first axial portion of the valve chamber 20 is smaller in diameter than the axial valve chamber 20 in the sleeve portion 16 of the nozzle member 12, and the second axial portion of the valve chamber 20 is larger in diameter than the first axial portion of the valve chamber 20. The flange portion 102 of the needle valve element 42 has a flat end face 102*a* directed toward and parallel with the inner flat end face 80*a* of the rod portion 80 of the push rod 76 as illustrated in FIG. 4.

The rod portion 80 of the push rod 76 axially projects from the boss portion 78 of the push rod 76 and extends through the bore 62 in the sleeve member 60 into the second spring chamber 54. The rod portion 80 extends toward and is aligned with the flange portion 102 of the needle valve element 42 and has a flat end face 80*a* directed toward the end face 102*a* of the flange portion 102.

The second pressure spring 64 axially extends in the second spring chamber 54 of the nozzle holder 10 and is seated at one end on an annular adjustment shim 68 received on the second fixed seat portion of the sleeve member 60. The second pressure spring 64 is seated at the other end on the inner end face of an annular movable spring seat element 104 located close to the spacer element 14. The movable spring seat element 104 has a flat end face 104*a* parallel with and confronting the inner end face 14*a* of the spacer element 14 and is urged by the second pressure spring 64 to have its end face 104*a* held in contact with the end face 14*a* of the spacer element 14 as illustrated in FIG. 4. The movable spring seat element 104 further has an axial bore 104*b* which is open at the opposite ends of the spring seat element 104.

The rod portion 80 of the push rod 76 axially extends toward the flange portion 102 of the needle valve element 42 through this bore 104*b* in the movable spring seat element 104 and has its end face 80*a* engageable with the end face 102*a* of the flange portion 102 within the central opening 52 in the spacer element 14. In a fuel injection valve assembly according to the present invention, the movable spring seat element 104 implements a first movable member while the push rod 76 implements a second movable member.

The fuel injection valve assembly constructed as hereinbefore described is fitted into one of the power cylinders of a diesel engine with a suitable axial portion such as the axial portion indicated at 10*a* of the nozzle holder 10 screwed through the cylinder head of the engine, though not shown in the drawings.

The first pressure spring 66 incorporated in the first spring chamber 56 and engaging the push rod 76 urges the push rod 76 toward the flange portion 102 of the needle valve element 42 until the boss portion 78 of the push rod 76 is received on the first seat portion of the sleeve member 60 across the annular adjustment shim 82. In the presence of fuel under pressure in the fuel discharge passageway 22 in the nozzle member 12, the needle valve element 42 is forced by the fuel pressure to axially move toward the movable spring seat element 104 in the second spring chamber 54. Thus, the flange portion 102 of the needle valve element 42 has its end face 102*a* brought into contact with the end face 80*a* of the rod portion 80 of the push rod 76 so that the force of the first pressure spring 66 urging the push rod 76 toward the needle valve element 42 is transmitted through the push rod 76 to the needle valve element 42 and opposes the force of the fuel under pressure acting on the needle valve element 42. The needle valve element 42 is accordingly held in an initial axial position closing the fuel discharge passageway 22 in the nozzle member 12. This initial axial position of the needle valve element 42 is maintained with an equilibrium established between the force of the first spring 66 acting on the push rod 76 and the force resulting from the fuel pressure acting on the needle valve element 42. The guide portion 44 of the needle valve element 42 held in the initial axial position has its end face 44*a* spaced apart a predetermined distance from the outer end face 14*b* of the spacer element 14. The distance between the outer end face 14*b* of the spacer element 14 and the end face 44*a* of the guide portion 44 of the needle valve element 42 held in the initial axial position defines the amount of full valve lift FL of the fuel injection valve assembly herein shown. Furthermore, the distance between the end face 102*a* of the flange portion 102 of the needle valve element 42 held in the initial axial position and the end face 104*a* of the movable spring seat element 104 seated on the inner end face 14*a* of the spacer element 14 defines the amount of preliminary valve lift PL of the fuel injection valve assembly herein shown.

When the force resulting from the fuel pressure acting on the needle valve element 42 overcomes the opposing force of the first pressure spring 66, the needle valve element 42 is caused to axially move from its initial axial position in a direction to open the fuel discharge passageway 22 in the nozzle member 12 until the needle valve element 42 reaches a first critical axial position having the end face 102*a* of its flange portion 102 brought into contact with the end face 104*a* of the movable spring seat element 104. The guide portion 44 of the needle valve element 42 held in the first critical axial position has its end face 44*a* spaced apart a predetermined distance from the outer end face 14*b* of the spacer element 14. The distance between the outer end face 14*b* of the spacer element 14 and the end face 44*a* of the guide portion 44 of the needle valve element 42 thus held in the first critical axial position defines the amount of full valve lift FL of the fuel injection valve assembly herein shown. Furthermore, the movement of the needle valve element 42 from the initial axial position to the first critical axial position provides the preliminary valve lift PL of the fuel injection valve assembly as has been noted. The amount of preliminary valve lift PL of the fuel injection valve assembly embodying the present invention can thus be adjusted by varying the thickness of the spacer element 14 to increase or decrease the spacing between the end face 104*a* of the movable spring seat element 104 seated on the spacer element 14 and the end face 102*a* of the flange portion 102 of the needle valve element 42 in the initial axial position thereof.

The second pressure spring 64 incorporated in the second spring chamber 54 and seated on the movable spring seat element 104 urges the spring seat element 104 to rest on the inner end face 14*a* of the spacer element 14. In the presence of fuel under pressure in the fuel discharge passageway 22 in the nozzle member 12 after the needle valve element 42 has been moved to the first critical axial position, the needle valve element 42 is caused to further move from the particular position and causes the movable spring seat element 104 to move away from the inner end face 14*a* of the spacer element 14. The needle valve element 42 being engaged by the spring seat element 104, the force of the second pressure spring 64 is transmitted through the movable spring seat element 104 to the needle valve element 42 so that the axial movement of the needle valve element 42 in the direction to open the fuel discharge passageway 22 is opposed by the force of the second pressure spring 64 in addition to the force of the first pressure spring 66. The needle valve element 42 is thus caused to move from the first critical position against the forces of the first and second pressure springs 66 and 64 until the needle valve element 42 reaches a second critical axial position having the end face 44*a* of its guide portion 44 brought into contact with the outer end face 14*b* of the spacer element 14. As has been noted, the movement of the needle valve element 42 from the first critical axial position to this second critical axial position provides the full valve lift FL of the fuel injection valve assembly.

From the above description it will have been understood that the needle valve element 42 moved from the initial axial position in the direction to open the fuel discharge passageway 22 in the nozzle member 12 is first subjected to the opposing force of the first pressure spring 66 alone and thereafter undergoes the opposing forces of both of the first and second pressure springs 66 and 64. More specifically, the needle valve element 42 is subjected to the opposing force of the first pressure spring 66 during its movement from the initial axial position to the first critical axial position and to the opposing forces of the first and second pressure springs 66 and 64 during its movement from the first critical axial position to the second critical axial position thereof.

The operation of the two-stage opening fuel injection valve assembly thus constructed and arranged in accordance with the present invention will now be described in detail.

During each cycle of operation of the diesel engine, the fuel under pressure supplied from the fuel injection pump is admitted through the fuel feed pipe into the fuel inlet passageway 34 in the connector 32 and is directed through the fuel passageway 36 in the nozzle holder 10, the aperture 38 in the spacer element 14 and the fuel passageway 40 in the nozzle member 12 into the fuel discharge passageway 22 in the tip portion 18 of the nozzle member 12. The fuel pressure thus developed in the fuel discharge passageway 22 in the nozzle member 12 acts on the needle valve element 42 which has been held in the initial axial position thereof and forces the needle valve element 42 to axially move toward the movable spring seat element 104 seated on the inner end face 14*a* of the spacer element 14. The needle valve element 42 being engaged by the push rod 76 with the end face 102*a* of its flange portion 102 contacted by the end face 80*a* of the rod portion 80 of the push rod 76, the axial movement of the needle valve element 42 from the initial axial position is opposed by the force of the first pressure spring 66 transmitted through the push rod 76 to the needle valve element 42. The needle valve element 42 is thus caused to move with the push rod 76 against the force of the first pressure spring 66 until the needle valve element 42 reaches the first critical axial position having the end face 102*a* of its flange portion 102 brought into pressing engagement with the end face 104*a* of the movable spring seat element 104. As has been noted, the distance of movement of the needle valve element 42 which is thus moved from the initial axial position to the first critical axial position provides the preliminary valve lift PL of the fuel injection valve assembly. The needle valve element 42 being thus moved the distance providing the preliminary valve lift PL, the fuel discharge passageway 22 in the nozzle member 12 is allowed to open so that the fuel which has been passed to the fuel discharge passageway 22 is discharged through the nozzle orifices 22 in the nozzle member 12 at a rate dictated by the preliminary valve lift PL of the fuel injection valve assembly.

By the fuel pressure developed in the fuel discharge passageway 22 in the nozzle member 12, the needle valve element 42 is caused to further move, now together with the movable spring seat element 104, in the direction to wider open the fuel discharge passageway 22 in the nozzle member 12. The force of the fuel under pressure urging the needle valve element 42 to move in this direction is now opposed not only by the force of the first pressure spring 66 but also by the force of the second pressure spring 64. The needle valve element 42 is thus caused to further move from its first critical axial position against the forces of the first and second pressure springs 66 and 64 until the needle valve element 42 reaches the second critical axial position having the end face 44*a* of its guide portion 44 brought into contact with the outer end face 14*b* of the spacer element 14. The distance of movement of the needle valve element 42 which is thus moved from the first critical axial position to the second critical axial position having the guide portion 44 thus brought into contact with the spacer element 14 provides the full valve lift FL of the fuel injection valve assembly as has been noted. The needle valve element 42 being thus further moved the distance providing the full valve lift FL, the fuel discharge passageway 22 in the nozzle member 12 is allowed to wider open so that the fuel in the fuel discharge passageway 22 is discharged through the nozzle orifices 22 in the nozzle member 12 at an increased rate dictated by the full valve lift FL of the fuel injection valve assembly.

The first preferred embodiment of the present invention as has been described hereinbefore is advantageous over the prior-art fuel injection valve assembly of FIGS. 1 and 2 in that the flange portion 102 of the needle valve element 42 is simpler in shape than the movable spring seat element 70 used in the prior-art valve assembly. The fuel injection valve assembly embodying the present invention can thus be fabricated with the preliminary valve lift PL defined to a desired degree of preciseness more easily and at a lower cost than in the case of the prior-art fuel injection valve assembly.

As has been noted, the fuel injection valve assembly embodying the present invention is fitted into a power cylinders of a diesel engine with the axial portion 10*a* of the nozzle holder 10 screwed through and tightened to the cylinder head of the engine. A stress is created in the axial portion 10*a* of the nozzle holder 10 and would cause a change in the longitudinal measurement of the nozzle holder 10 after the valve assembly is fitted to the engine power cylinder. The axial portion of the nozzle holder 10 accommodating the first pressure spring 66 contributing to the formation of the preliminary valve lift PL extends outwardly of the cylinder head to which the fuel injection valve assembly is secured and is therefore isolated from the stress created in the axial portion 10*a*. The amount of preliminary valve lift PL of the fuel injection valve assembly is for this reason practically free from the influence of the stress caused in the axial portion 10*a* of the nozzle holder 10 so that the preciseness of the preliminary valve lift PL set up during fabrication of the fuel injection valve assembly can be maintained substantially throughout use of the valve assembly.

Figure 5:
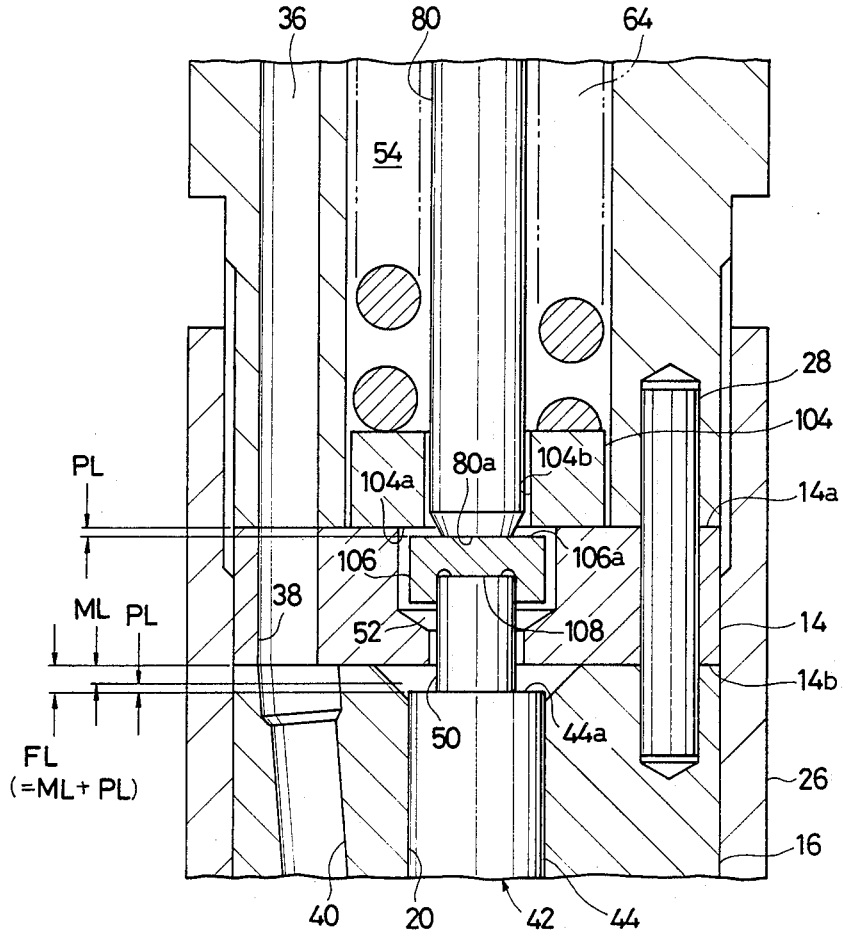
FIG. 5 is a longitudinal sectional view showing part of a second preferred embodiment of a fuel injection valve assembly according to the present invention.

[Second Preferred Embodiment] (FIG. 5)

FIG. 5 shows a second preferred embodiment of a two-stage opening fuel injection valve assembly proposed by the present invention.

The embodiment of the present invention herein shown is a modification of the two-stage opening fuel injection valve assembly hereinbefore described with reference to FIGS. 3 and 4. The fuel injection valve assembly shown in FIG. 5 is similar in construction to the valve assembly of FIGS. 3 and 4 except in that a flange member 106 which implements intervening means in the embodiment herein shown is provided in substitution for the flange portion 102 of the needle valve element 42 used in the embodiment of FIGS. 3 and 4. While the flange portion 102 of the needle valve element 42 incorporated in the embodiment of FIGS. 3 and 4 is part of the needle valve element 42 per se, the flange member 106 used in the embodiment herein shown is formed separately of the needle valve element 42 and is held in engagement with the stem portion 50 of the needle valve element 42. This flange member 106 is provided in the form of a disc member having a flat end face 106*a* identical with the end face 102*a* of the flange portion 102 of the needle valve element 42 in the embodiment of FIGS. 3 and 4. The flange member 106 further has a circular concavity 108 which is shaped conformingly to a leading end portion of the stem portion 50 of the needle valve element 42 as shown. Thus, the stem portion 50 of the needle valve element 42 fuel injection valve assembly has its leading end portion snugly received in the circular concavity 108 in the flange member 106 so that the flange member 106 acts similarly to the flange portion 102 of the needle valve element 42 in the embodiment of FIGS. 3 and 4 with respect to the movable spring seat element 104 and the rod portion 80 of the push rod 76. If desired, the flange member 106 may be secured to the needle valve element 42 by means of any adhesive or by mechanical fastening means such as a screw or a stud, though not shown in the drawings.

In the embodiment of FIG. 5, the preliminary valve lift PL of the valve assembly is defined between the end face 106*a* of the flange member 106 attached to the needle valve element 42 held in the initial axial position and the end face 104*a* of the movable spring seat element 104 seated on the inner end face 14*a* of the spacer element 14. The full valve lift FL is defined between the end face 44*a* of the guide portion 44 of the needle valve element 42 in the initial axial position and the outer end face 14*b* of the spacer element 14. The full valve lift FL of the valve assembly is defined between the outer end face 14*b* of the spacer element 14 and the end face 44*a* of the guide portion 44 of the needle valve element 42 moved to the first critical axial position thereof.

The embodiment of the present invention illustrated in FIG. 5 is advantageous over the embodiment of FIGS. 3 and 4 in that the needle valve element 42 used in the former is per se similar to that used in the prior-art valve assembly hereinbefore described with reference to FIGS. 1 and 2. Thus, the needle valve element 42 fabricated for use in the prior-art valve assembly can be utilized without modification as the needle valve element 42 in the fuel injection valve assembly illustrated in FIG. 5. Another advantage of the fuel injection valve assembly shown in FIG. 5 is that the amount of preliminary valve lift PL can be readily varied through selection of the thickness of the flange member 106 which is formed separately of the needle valve element 42.

Figure 6:
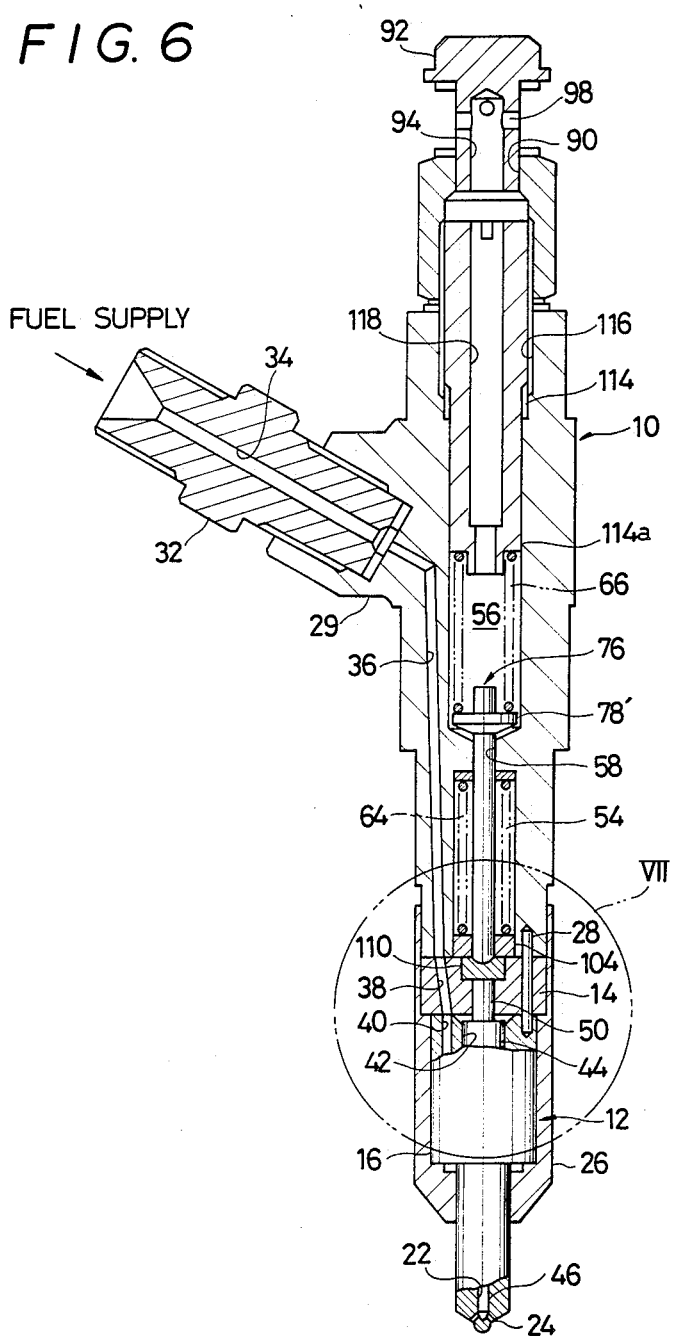
FIG. 6 is a longitudinal sectional view showing a third preferred embodiment of a fuel injection valve assembly according to the present invention.
Figure 7:
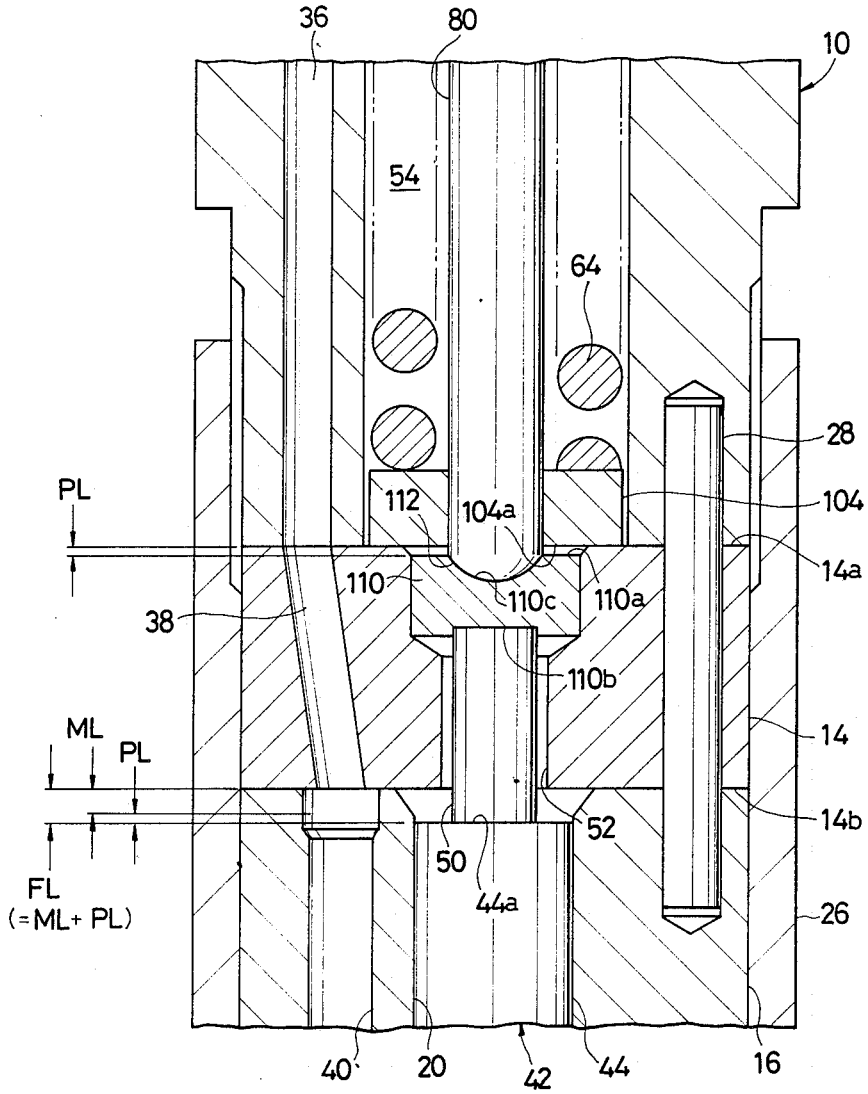
FIG. 7 is a sectional view showing, to an enlarged scale, the detailed construction of a portion of the valve assembly of FIG. 6 indicated at VII in FIG. 6.

[Third Preferred Embodiment] (FIGS. 6 and 7)

FIGS. 6 and 7 show a third preferred embodiment of a two-stage opening fuel injection valve assembly proposed by the present invention.

The embodiment of the present invention herein shown is another modification of the two-stage opening fuel injection valve assembly hereinbefore described with reference to FIGS. 3 and 4. The fuel injection valve assembly herein shown is further similar to the embodiment of FIG. 5 in that a flange member, now represented by reference numeral 110, is provided as intervening means in substitution for the flange portion 102 of the needle valve element 42 used in the embodiment of FIGS. 3 and 4 and is formed separately of the needle valve element 42. The flange member 110 used in the embodiment herein shown is thus also held in engagement with the stem portion 50 of the needle valve element 42 or may be secured to the needle valve element 42 by means of any adhesive or by mechanical fastening means such as a screw or a stud. The flange member 110 has an end face 110*a* opposite to the stem portion 50 of the needle valve element 42 and is formed with a circular concavity 110*b* in which is closely received a leading end portion of the stem portion 50 of the needle valve element 42.

In the embodiment shown in FIGS. 6 and 7, the flange member 110 engaged by or secured to the stem portion 50 of the needle valve element 42 has a hemispherically dished concavity 110*c* which is axially open at its end face 110*a* opposite to the stem portion 50 of the needle valve element 42 as illustrated to an enlarged scale in FIG. 7. The concavity 110*c* may be press forged into the flange member 110. The rod portion 80 of the push rod 76 has a rounded end portion 112 shaped conformingly to the hemispherical concavity 110*c* and slidably received in the concavity 110*c*. The needle valve element 42, flange member 110 and push rod 76 have respective center axes aligned with each other so that, when the push rod 76 or, particularly, the rod portion 80 of the push rod 76 happens to incline with respect to the flange member 110 during its axial movement in the nozzle holder 10, the inclination of the push rod 76 or the rod portion thereof is taken up by the sliding movement of the rounded end portion of the rod portion 80. The flange member 110 is thus prevented from being inclined with respect to the movable spring seat element 104 and is enabled to maintain its correct position with respect to the spring seat element 104 so that the initial degree of preciseness of, particularly, the preliminary valve lift PL of the valve assembly can be maintained throughout use of the valve assembly.

In the embodiment shown in FIGS. 6 and 7, furthermore, the bore portion forming the first spring chamber 56 in the nozzle holder 10 is significantly longer than the bore portion forming the second spring chamber 54 in the nozzle holder 10. In substitution for the fixed spring seat element 86 incorporated in the bore portion forming the first spring chamber 56 in the nozzle holder 10 of the embodiment of FIGS. 3 and 4 or the embodiment of FIG. 5 is provided a generally cylindrical externally threaded member fixedly fitted into the bore portion forming the spring chamber 56 to implement an adjustment screw 114. The adjustment screw 114 has an externally threaded axial portion engaged by an internally threaded axial portion of the nozzle holder 10 as indicated at 116 in FIG. 6 and is secured to the nozzle holder 10 at its end opposite to the spacer element 14 by means of a cap member 88. As in the embodiment described with reference to FIGS. 3 and 4, the cap member 88 has an end portion formed with an opening 90 through which a plug member 92 is fitted to the cap member 88. The plug member 92 has an axial bore 94 communicating with the first spring chamber 56 in the nozzle holder 10 through an axial bore 118 formed in the adjustment screw 114 and extending throughout the length of the screw 114. The push rod 76 extending into the first spring chamber 56 in the embodiment herein shown has a flange portion 78' in lieu of the boss portion 78 of the push rod 76 in each of the described first and second embodiments of the present invention. Furthermore, the sleeve member 60 extending between the first and second spring chambers 56 and 54 through the bore portion 58 of the nozzle holder 10 in each of the first and second embodiments of the present invention is dispensed with in the embodiment herein shown. Thus, the elongated rod portion 80 of the push rod 76 axially projects from the flange portion 78' of the push rod 76 and extends directly through the axial bore portion 58 in the nozzle holder 10 into the second spring chamber 54.

The adjustment screw 114 has an axial end portion projecting into the first spring chamber 56 to form an annular spring seat portion 114*a* around the end portion. The first pressure spring 66 provided in the first spring chamber 56 is seated at one end on one end face of the flange portion 78 of the push rod 76 and at the other end on the flange portion 78' of the push rod 76. The force of the pressure spring 66 thus extending longitudinally in the first spring chamber 56 in a preloaded state is thus determined by the length to which the adjustment screw 114 projects into the spring chamber 56 and can be readily adjusted by varying the length to which the screw 114 is threadedly fitted into the nozzle holder 10.

In the embodiment of FIGS. 6 and 7, the preliminary valve lift PL of the valve assembly is also defined between the end face 110*a* of the flange member 110 attached to the needle valve element 42 held in the initial axial position and the end face 104*a* of the movable spring seat element 104 seated on the inner end face 14*a* of the spacer element 14. The full valve lift FL is defined between the and face 44*a* of the guide portion 44 of the needle valve element 42 in the initial axial position and the outer end face 14*b* of the spacer element 14. The full valve lift FL of the valve assembly is defined between the outer end face 14*b* of the spacer element 14 and the end face 44*a* of the guide portion 44 of the needle valve element 42 moved to the first critical axial position thereof.

It will have been understood from the foregoing description that the embodiment of the present invention hereinbefore described with reference to FIGS. 6 and 7 is characterized inter alia by the slidable engagement between the rounded end portion of the rod portion 80 of the push rod 76 and the helispherically dished concavity 110*c* in the movable spring seat element 104. By reason of such engagement between the push rod 76 and movable spring seat element 104, the flange member 110 intervening between the needle valve element 42 and push rod 76 is allowed to maintain its correct position with respect to the spring seat element 104 so that the initial degree of preciseness of, particularly, the preliminary valve lift PL of the valve assembly is maintained throughout use of the valve assembly. The embodiment of FIGS. 6 and 7 is further advantageous in that the needle valve element 42 used in the valve assembly is per se also similar to that used in the prior-art valve assembly hereinbefore described with reference to FIGS. 1 and 2 and, for this reason, the needle valve element 42 fabricated for use in the prior-art valve assembly can be utilized without modification in the fuel injection valve assembly of FIGS. 6 and 7. Another advantage of the fuel injection valve assembly shown in FIGS. 6 and 7 is that the amount of preliminary valve lift PL can be readily varied through selection of the thickness of the flange member 110 which is formed separately of the needle valve element 42.

Figure 8:
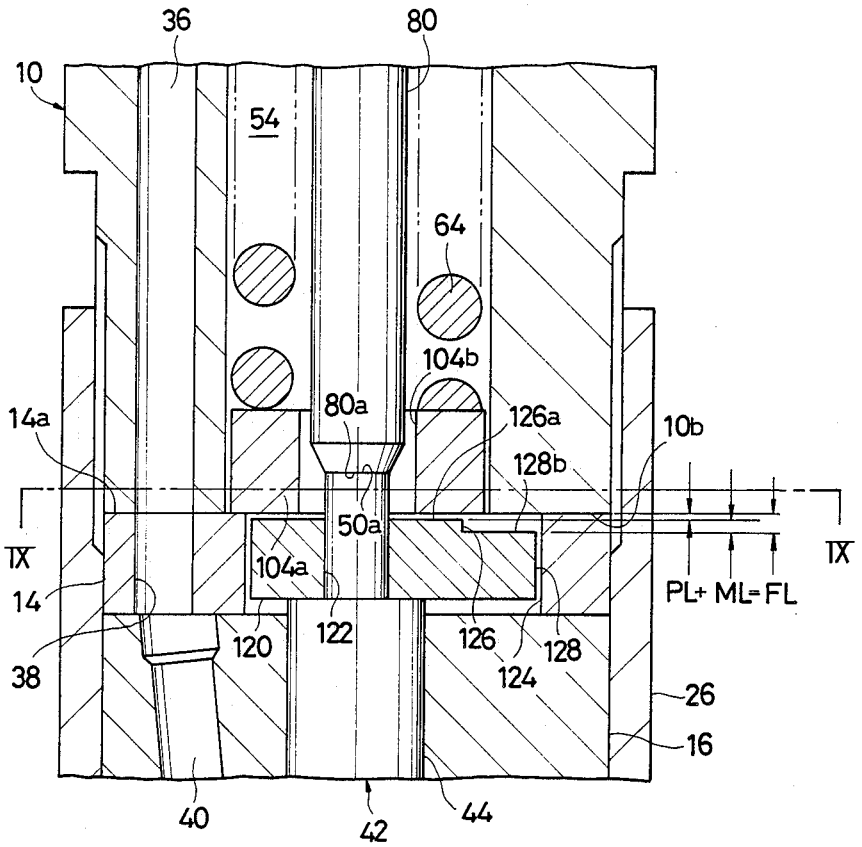
FIG. 8 is a longitudinal sectional view showing part of a fourth preferred embodiment of a fuel injection valve assembly according to the present invention.
Figure 9:
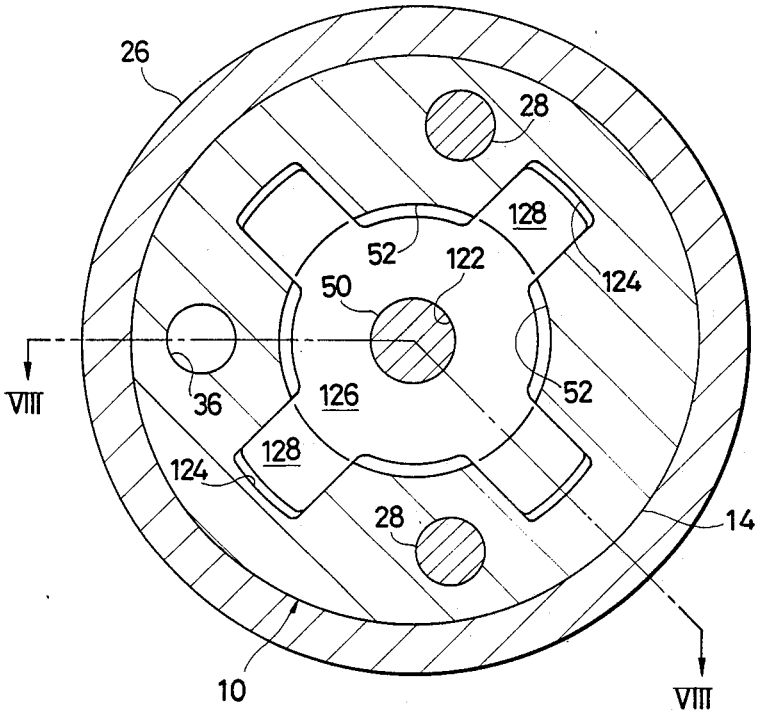
FIG. 9 is a cross sectional view taken on line IX—IX in FIG. 8 which is taken along line VIII—VIII in FIG. 9.

[Fourth Preferred Embodiment] (FIGS. 8 and 9)

FIGS. 8 and 9 show a fourth preferred embodiment of a two-stage opening fuel injection valve assembly proposed by the present invention. The embodiment of the present invention herein shown is also a modification of the two-stage opening fuel injection valve assembly hereinbefore described with reference to FIGS. 3 and 4.

In the embodiment herein shown, the flange member, now represented by reference numeral 120, has an axial bore 122 which is open at the opposite ends of the flange member 120 and has the stem portion 50 of the needle valve element 42 securely received in the bore 122. The stem portion 50 of the needle valve element 42 thus axially extends through the axial bore 122 in the flange member 120 and projects into the second spring chamber 54 or, more specifically, into the axial bore 104*b* in the movable spring seat element 104 as shown. Thus, the needle valve element 42 is constantly engaged by the push rod 76 with the end face 50*a* of its stem portion 102 held in contact with the end face 80*a* of the rod portion 80 of the push rod 76 by the force of the first pressure spring 64 and the fuel under pressure in the fuel discharge passageway 22 in the nozzle member 12.

The spacer element 14 incorporated in the embodiment of FIGS. 8 and 9 has in addition to the circular central opening 52 a plurality of groove portions 124 radially merging outwardly out of the central opening 52 and arranged at equal angles with respect to each other about the center axis of the opening 52 as will be better seen from FIG. 9. The flange member 120 engaging the spacer element 14 accordingly has a generally cylindrical or disc-shaped center portion 126 formed with the axial bore 122 and and a plurality of radial limb portions 128 radially protruding from the center portion 126. The center portion 126 of the flange member 120 is slidably received in the central opening 52 in the spacer element 14 and the radial limb portions 128 of the flange member 120 are respectively received in the groove portions 124 in the spacer element 14.

The center portion 126 of the flange member 120 has an outside diameter smaller than the diameter of the second spring chamber 54 and has a flat end face 126*a* parallel with and confronting the end face 104*a* of the movable spring seat element 104. Each of the radial limb portions 128 of the flange member 120 extend in proximity to the flat end face 10*b* which the nozzle holder 10 has adjacent to the inner end face 14*a* of the spacer element 14 and has a flat end face 128*a* parallel with and confronting the end face 10*b* of the nozzle holder 10 as shown in FIG. 8. The end face 128*a* of each of the radial limb portions 128 of the flange member 120 is lower than the end face 126*a* of the center portion 126 of the flange member 120 or, in other words, the plane defined by the end face 128*a* of each limb portion 128 is spaced apart more from the plane defined by the inner end face 14*a* of the spacer element 14 than the plane defined by the end face 126*a* of the center portion 126 of the flange member 120. Thus, the flange member 120 provided in the embodiment herein shown has a first end face implemented by the end face 126 of its center portion 126 and a second end face implemented by the end face 128*a* of each of its radial limb portions 128 and lower than the first end face.

In operation, the fuel under pressure developed in the fuel discharge passageway 22 in the nozzle member 12 acts on the needle valve element 42 held in the initial axial position thereof and forces the needle valve element 42 to axially move toward the movable spring seat element 104 seated on the inner end face 14*a* of the spacer element 14 by the force of the second pressure spring 66. The needle valve element 42 being engaged by the push rod 76 with the end face 50*a* of its stem portion 102 contacted by the end face 80*a* of the rod portion 80 of the push rod 76, the axial movement of the needle valve element 42 from the initial axial position is opposed by the force of the first pressure spring 66 transmitted through the push rod 76 to the needle valve element 42. The needle valve element 42 is thus caused to move with the push rod 76 against the force of the first pressure spring 66 until the needle valve element 42 reaches a first critical axial position having the end face 126*a* of its flange member 120 brought into pressing engagement with the end face 104*a* of the movable spring seat element 104. The distance of movement of the needle valve element 42 which is thus moved from the initial axial position to the first critical axial position provides the preliminary valve lift PL of the fuel injection valve assembly under consideration. The needle valve element 42 being thus moved the distance providing the preliminary valve lift PL, the fuel discharge passageway 22 in the nozzle member 12 is allowed to open so that the fuel which has been passed to the fuel discharge passageway 22 is discharged through the nozzle orifices 22 in the nozzle member 12 at a rate dictated by the preliminary valve lift PL of the fuel injection valve assembly.

By the fuel pressure developed in the fuel discharge passageway 22 in the nozzle member 12, the needle valve element 42 is caused to further move, now together with the movable spring seat element 104, in the direction to wider open the fuel discharge passageway 22 in the nozzle member 12. The force of the fuel under pressure urging the needle valve element 42 to move in this direction is now opposed not only by the force of the first pressure spring 66 but by the force of the second pressure spring 64. The needle valve element 42 is thus caused to further move from its first critical axial position against the forces of the first and second pressure springs 66 and 64 until the needle valve element 42 reaches a second critical axial position having the respective end faces 128*a* of the radial limb portions 128 of the flange member 120 brought into contact with the end face 10*b* of the nozzle holder 10. The distance of movement of the needle valve element 42 which is thus moved from the first critical axial position to the second critical axial position having the radial limb portions 128 of the flange member 120 thus brought into contact with the end face 10*b* of the nozzle holder 10 provides the full valve lift FL of the fuel injection valve assembly under consideration. The needle valve element 42 being thus further moved the distance providing the full valve lift FL, the fuel discharge passageway 22 in the nozzle member 12 is allowed to wider open so that the fuel in the fuel discharge passageway 22 is discharged through the nozzle orifices 22 in the nozzle member 12 at an increased rate dictated by the full valve lift FL of the fuel injection valve assembly.

From the above description it will have been understood that the preliminary valve lift PL of the valve assembly implementing the fourth preferred embodiment of the present invention is defined between the first end face 126*a* of the flange member 120 fixedly engaging the needle valve element 42 held in the initial axial position and the end face 104*a* of the movable spring seat element 104 seated on the inner end face 14*a* of the spacer element 14. The full valve lift FL is defined between the second end faces 128*a* of the flange member 120 engaging the needle valve element 42 in the initial axial position and the end face 10*b* of the nozzle holder 10 or, in other words, a plane defined by the inner end face 14*a* of the spacer element 14. The full valve lift FL of the valve assembly is defined between the end face 104*a* of the movable spring seat element 104 and the second end faces 128*a* of the flange member 120 engaging the needle valve element 42 moved to the first critical axial position thereof.

The fourth preferred embodiment of the present invention as has been described hereinbefore is also advantageous over the prior-art fuel injection valve assembly of FIGS. 1 and 2 in that the flange member 120 fixedly engaging the needle valve element 42 is simpler in shape than the movable spring seat element 70 used in the prior-art valve assembly. The fuel injection valve assembly embodying the present invention can thus be fabricated with the preliminary valve lift PL defined to a desired degree of preciseness more easily and at a lower cost than in the case of the prior-art fuel injection valve assembly.

What is claimed is:

1. A two-stage opening fuel injection valve assembly, comprising (a) a valve element having an initial position providing a substantially zero flow rate of fuel through the valve assembly, a first critical position displaced a first predetermined distance from the initial position in a predetermined direction and providing a first flow rate of fuel through the valve assembly, a second critical position further displaced a second predetermined distance from the first critical position in said predetermined direction and providing a second flow rate of fuel through the valve assembly, (b) first and second movable members which are engageable with said valve element independently of each other, (c) intermediate means constantly engaged by said valve element and engageable with each of said first and second movable members, (d) first biasing means urging said first movable member toward a predetermined position to engage said intermediate means when said valve element is held in said initial position, the first biasing means being operative to maintain the engagement between said first movable member and said intermediate means when the valve element is located between said initial position and said first critical position, (e) second biasing means urging said second movable member toward a predetermined position to engage said intermediate means when said valve element is moved from said initial position to one of said first and second critical positions, the second biasing means being operative to maintain the engagement between said second movable member and said intermediate means when the valve element is located between said first and second critical positions, and (f) displacement limiting means preventing movement of said valve element beyond said second critical position in said predetermined direction.

2. A two-stage opening fuel injection valve assembly as set forth in claim 1, in which said second biasing means urges said second movable member toward said predetermined position to engage said intermediate means when said valve element is held in said first critical position.

3. A two-stage opening fuel injection valve assembly as set forth in claim 1, in which said second biasing means urges said second movable member toward said predetermined position to engage said intermediate means when said valve element is held in said second critical position.

4. A two-stage opening fuel injection valve assembly as set forth in claim 1, in which said intermediate means comprises a portion of said valve element.

5. A two-stage opening fuel injection valve assembly as set forth in claim 1, in which said intermediate means comprises a flange member formed separately of and constantly engaged by said valve element, said flange member being located between said valve element and said first movable member.

6. A two-stage opening fuel injection valve assembly as set forth in claim 5, in which said flange member has a substantially hemispherically dished concavity which is open toward said first movable member and which has a center axis substantially parallel with said predetermined direction, said first movable member having a generally hemispherically rounded end portion slidably received in said concavity.

7. A two-stage opening fuel injection valve assembly as set forth in claim 1, in which said intermediate means comprises a flange member formed separately of and constantly engaged by said valve element, said flange member having a bore through which said valve element is engageable with said first movable member, a first end face spaced apart said first predetermined distance from said second movable member when said valve element is held in said initial position, a second end face spaced apart the sum of said first and second predetermined distances from said second movable member when said valve element is held in said initial position.

8. A two-stage opening fuel injection valve assembly having a full valve lift and a preliminary valve lift which forms part of the full valve lift, comprising (a) a casing structure having formed therein a fuel passageway into which is to be directed fuel under pressure, a substantially flat fixed internal surface portion, and first and second chambers arranged in series with each other perpendicularly to said fixed internal surface portion, (b) first and second biasing means provided in said first and second chambers, respectively, (c) a first movable member movable in part within said first chambers and in part within said second chambers, (d) a second movable member movable within said second chambers and located in the vicinity of the end of the second chambers opposite to the first chamber, said second movable member having an end face substantially parallel with and confronting said fixed internal surface portion, said second biasing means constantly engaging said second movable member for urging the second movable member into contact with said fixed internal surface portion, (e) a valve element located in the vicinity of said second movable member and movable toward and away from the second movable member for controlling the flow rate of fuel through said fuel passageway, (f) said first movable member being constantly engaged by said first biasing means and said valve element in the presence of fuel pressure in said fuel passageway for transmitting from the first biasing means to the valve element a force urging the valve element toward a predetermined initial position with respect to the second movable member held in contact with said fixed internal surface portion, and (g) intermediate means intervening between said first movable member and said valve element, the intermediate means being movable with said valve element and having an end face substantially parallel with and located adjacent to the end face of said second movable member, (h) the distance between the end face of said second movable member and the end face of the intermediate means engaging the valve element held in said initial position defining the amount of said preliminary valve lift.

9. A two-stage opening fuel injection valve assembly as set forth in claim 8, in which said fixed internal surface portion is one of first and second fixed internal surface portions formed in said casing structure and substantially parallel with each other and is constantly contacted by said second movable member and in which said valve element has an end face substantially parallel with and located adjacent said second fixed internal surface portion, the distance between said second fixed internal surface portion and the end face of the valve element held in said initial position defining the amount of said full valve lift.

10. A two-stage opening fuel injection valve assembly as set forth in claim 9, in which said casing structure comprises a nozzle holder having said first and second chambers formed therein, a nozzle member having said fuel passageway formed therein and a spacer element intervening between the nozzle holder and the nozzle member and having formed therein an opening through which said valve element is held in engagement with said first movable member in the presence of fuel pressure in said fuel passageway, said spacer element having first and second end faces substantially parallel with the end face of said second movable member, said first end face of said spacer element forming said first fixed internal surface portion and being located adjacent to said end face of said second movable member, said second end face of said spacer element forming said second fixed internal surface portion and being substantially parallel with and located adjacent to said end face of the valve element held in said initial position.

11. A two-stage opening fuel injection valve assembly as set forth in claim 9, in which said intermediate means comprises a portion of said valve element, said portion of said valve element being movable within said opening in said spacer element and being held in engagement with said first movable member through said opening.

12. A two-stage opening fuel injection valve assembly as set forth in claim 9, in which said intermediate means comprises a flange member formed separately of and constantly engaging said valve element and having an end face substantially parallel with and located adjacent to the end face of said second movable member and forming said end face of said intermediate means.

13. A two-stage opening fuel injection valve assembly as set forth in claim 12, in which said flange member has formed therein a substantially hemispherically dished concavity which is open at a plane defined by the end face of said flange member, said first movable member having a generally hemispherically rounded end portion slidably received in said concavity in the presence of fuel under pressure in said fuel passageway.

14. A two-stage opening fuel injection valve assembly as set forth in claim 8, in which said intermediate means comprises a flange member formed separately of and securely engaged by said valve element and having a bore through which said valve element is held in engagement with said first movable member in the presence of fuel pressure in said fuel passageway, said flange member having a first end face defining a plane substantially parallel with and located adjacent to a plane defined by said fixed internal surface portion and a second end face defining a plane substantially parallel with the plane defined by said first end face and spaced apart more from the plane defined by said fixed internal surface portion than the plane defined by said first end face, the distance between the plane defined by said fixed internal surface portion and the plane defined by the first end face of the flange member engaging the valve element held in said initial position defining the amount of said preliminary valve lift, and the distance between the plane defined by said fixed internal surface portion and the plane defined by the second end face of the flange member engaging the valve element held in said initial position defining the amount of said full valve lift.

15. A two-stage opening fuel injection valve assembly as set forth in claim 8, in which said casing structure comprises a nozzle holder having said first and second chambers formed therein, a nozzle member having said fuel passageway formed therein and a spacer element intervening between the nozzle holder and nozzle member and having formed therein an opening through which said valve element is held in engagement with said first movable member in the presence of fuel pressure in said fuel passageway, said spacer element having an end face substantially parallel with and located adjacent to the end face of said second movable member, said fixed internal surface portion being formed by said end face of said spacer element.

16. A two-stage opening fuel injection valve assembly as set forth in claim 15, in which said intermediate means comprises a flange member formed separately of and securely engaged by said valve element and having a bore through which said valve element is held in engagement with said first movable member in the presence of fuel pressure in said fuel passageway, said flange member having a first end face defining a plane substantially parallel with and located adjacent to a plane defined by said end face of said spacer element and a second end face defining a plane substantially parallel with the plane defined by said first end face and spaced apart more from the plane defined by said first end face than the plane defined by said first end face, the distance between the plane defined by said end face of said spacer element and the plane defined by the first end face of the flange member engaging the valve element held in said initial position defining the amount of said preliminary valve lift, and the distance between the plane defined by said end face of said spacer element and the plane defined by the second end face of the flange member engaging the valve element held in said initial position defining the amount of said full valve lift.

17. A two-stage opening fuel injection valve assembly having a full valve lift and a preliminary valve lift which forms part of the full valve lift, comprising (a) a casing structure having formed therein a fuel passageway into which is to be directed fuel under pressure, substantially flat first and second fixed internal surface portions substantially parallel with each other, and first and second chambers arranged in series with each other perpendicularly to said fixed internal surface portions, (b) first and second biasing means provided in said first and second chambers, respectively, (c) a first movable member movable in part within said first chambers and in part within said second chambers, (d) a second movable member movable within said second chambers and located in the vicinity of the end of the second chambers opposite to the first chamber, said second movable member having an end face substantially parallel with said first and second fixed internal surface portions and located at said end of said second chambers, and second biasing means constantly engaging said second movable member for urging the second movable member into contact with said first fixed internal surface portion, (e) a valve element located in the vicinity of said second movable member and movable toward and away from the second movable member for controlling the flow rate of fuel through said fuel passageway, said valve element having an end face substantially parallel with and located adjacent said second fixed internal surface portion, (f) said first movable member being constantly engaged by said first biasing means and said valve element in the presence of fuel pressure in said fuel passageway for transmitting from the first biasing means to the valve element a force urging the valve element toward a predetermined initial position with respect to the second movable member held in contact with said first fixed internal surface portion, and (g) intermediate means intervening between said first movable member and said valve element, the intermediate means being movable with said valve element and having an end face substantially parallel with and located adjacent to the end face of said second movable member, (h) the distance between the end face of said second movable member and the end face of the intermediate means engaging the valve element held in said initial position defining the amount of said preliminary valve lift, and the distance between said second fixed internal surface portion and the end face of the valve element held in said initial position defining the amount of said full valve lift.

18. A two-stage opening fuel injection valve assembly having a full valve lift and a preliminary valve lift which forms part of the full valve lift, comprising (a) a casing structure having formed therein a fuel passageway into which is to be directed fuel under pressure, a substantially flat fixed internal surface portion, and first and second chambers arranged in series with each other perpendicularly to said fixed internal surface portion, (b) first and second biasing means provided in said first and second chambers, respectively, (c) a first movable member movable in part within said first chambers and in part within said second chambers, (d) a second movable member movable within said second chambers and located in the vicinity of the end of the second chambers opposite to the first chamber, said second movable member having an end face substantially parallel with said fixed internal surface portion and located at said end of said second chambers, said second biasing means constantly engaging said second movable member for urging the second movable member into contact with said fixed internal surface portion, (e) a valve element located in the vicinity of said second movable member and movable toward and away from the second movable member for controlling the flow rate of fuel through said fuel passageway, (f) said first movable member being constantly engaged by said first biasing means and said valve element in the presence of fuel pressure in said fuel passageway for transmitting from the first biasing means to the valve element a force urging the valve element toward a predetermined initial position with respect to the second movable member held in contact with said fixed internal surface portion, and (g) intermediate means intervening between said first movable member and said valve element, the intermediate means being movable with said valve element and having a first end face defining a plane substantially parallel with and located adjacent to a plane defined by said fixed internal surface portion and a second end face defining a plane substantially parallel with the plane defined by said first end face and spaced apart more from the plane defined by said fixed internal surface portion than a plane defined by said first end face, (h) the distance between the plane defined by said fixed internal surface portion and the plane defined by the first end face of the intermediate means member engaging the valve element held in said initial position defining the amount of said preliminary valve lift, and the distance between the plane defined by said fixed internal surface portion and the plane defined by the second end face of the intermediate means engaging the valve element held in said initial position defining the amount of said full valve lift.

19. A two-stage opening fuel injection valve assembly having a full valve lift and a preliminary valve lift which forms part of the full valve lift, comprising (a) a casing structure having formed therein a fuel passageway into which is to be directed fuel under pressure, a substantially flat fixed internal surface portion, and first and second chambers arranged in series with each other perpendicularly to said fixed internal surface portion, (b) first and second biasing means provided in said first and second chambers, respectively, (c) a first movable member movable in part within said first chambers and in part within said second chambers, (d) a second movable member movable within said second chambers and located in the vicinity of the end of the second chambers opposite to the first chamber, said second movable member having an end face substantially parallel with and confronting said fixed internal surface portion, said second biasing means constantly engaging said second movable member for urging the second movable member into contact with said fixed internal surface portion, (e) a valve element located in the vicinity of said second movable member and movable toward and away from the second movable member for controlling the flow rate of fuel through said fuel passageway, (f) said first movable member being constantly engaged by said first biasing means and said valve element in the presence of fuel pressure in said fuel passageway for transmitting from the first biasing means to the valve element a force urging the valve element toward a predetermined initial position with respect to the second movable member held in contact with said fixed internal surface portion, and (g) intermediate means intervening between said first movable member and said valve element, the intermediate means being movable with said valve element and having an end face substantially parallel with and located adjacent to the end face of said second movable member, (h) said valve element being movable from said initial position to a first critical position having the end face of said intermediate means held in contact with the end face of said second movable member for defining the amount of said preliminary valve lift by the distance between the end face of said second movable member and the end face of the intermediate means engaging the valve element held in said initial position.

20. A two-stage opening fuel injection valve assembly as set forth in claim 19, in which said fixed internal surface portion is one of first and second fixed internal surface portions formed in said casing structure and substantially parallel with each other and is constantly contacted by said second movable member and in which said valve element has an end face substantially parallel with and located adjacent said second fixed internal surface portion, said valve element being further movable from said first critical position to a second critical position having its end face contacted by said second fixed internal surface portion for defining the amount of said full valve lift by the distance between said second fixed internal surface portion and the end face of the valve element held in said initial position.

21. A two-stage opening fuel injection valve assembly as set forth in claim 19, in which said intermediate means comprises a flange member formed separately of and securely engaged by said valve element and having a bore through which said valve element is held in engagement with said first movable member in the presence of fuel pressure in said fuel passageway, said flange member having a first end face defining a plane substantially parallel with and located adjacent to a plane defined by said fixed internal surface portion and a second end face defining a plane substantially parallel with the plane defined by said first end face and spaced apart more from the plane defined by said fixed internal surface portion than a plane defined by said first end face, said valve element being further movable from said first critical position to a second critical position having the second end face of said flange member located at a plane defined by said fixed internal surface portion for defining the amount of said full valve lift by the distance between the plane defined by said fixed internal surface portion and the second end face of said flange member engaged by the valve element held in said initial position.

* * * * *